US011228077B2

(12) United States Patent
Patotski

(10) Patent No.: US 11,228,077 B2
(45) Date of Patent: Jan. 18, 2022

(54) MICROSTRIP DC BLOCK

(71) Applicant: Carrier Corporation, Palm Beach Gardens, FL (US)

(72) Inventor: Marat Patotski, Gdansk (PL)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 16/901,803

(22) Filed: Jun. 15, 2020

(65) Prior Publication Data

US 2020/0395647 A1 Dec. 17, 2020

(51) Int. Cl.
*H01P 3/08* (2006.01)
*H01P 1/203* (2006.01)

(52) U.S. Cl.
CPC ..... *H01P 3/081* (2013.01); *H01P 1/2039* (2013.01)

(58) Field of Classification Search
CPC ..... H01P 3/081; H01P 1/2039
See application file for complete search history.

(56) References Cited

U.S. PATENT DOCUMENTS

| | | | |
|---|---|---|---|
| 7,734,319 | B2 | 6/2010 | Akasegawa |
| 8,593,225 | B2 | 11/2013 | Hellberg |
| 9,625,556 | B1 | 4/2017 | Tsironis |
| 2007/0194864 | A1 | 8/2007 | Yoon et al. |
| 2013/0106520 | A1 | 5/2013 | Hellberg |

FOREIGN PATENT DOCUMENTS

| | | | |
|---|---|---|---|
| CN | 101853975 | A | 10/2010 |
| CN | 103825075 | A | 5/2014 |
| CN | 103915666 | A | 7/2014 |
| CN | 203760606 | U | 8/2014 |
| CN | 203760613 | U | 8/2014 |
| CN | 104466318 | A | 3/2015 |
| CN | 104795612 | A | 7/2015 |
| CN | 105322252 | A | 2/2016 |
| CN | 105514545 | A | 4/2016 |
| CN | 105576336 | A | 5/2016 |

(Continued)

OTHER PUBLICATIONS

Machine Translation of Yang et al., CN 107146932, accessed May 6, 2021 (Year: 2017).*

(Continued)

*Primary Examiner* — Samuel S Outten
(74) *Attorney, Agent, or Firm* — Cantor Colburn LLP

(57) ABSTRACT

A microstrip DC block includes a first signal line having a first signal line end and a first centreline ($C_1$); a second signal line having a second signal line end and a second centreline ($C_2$); a first spur-line extending from the first signal line end towards the second signal line end; a first stepped impedance line extending from the first signal line end towards the second signal line end, wherein the first stepped impedance line is parallel to the first spur line; a second spur-line extending from the second signal line end towards the first signal line end; a second stepped impedance line extending from the second signal line end towards the first signal line end, wherein the second stepped impedance line is parallel to the second spur line, and wherein the second stepped impedance line is coupled to the first stepped impedance line.

12 Claims, 2 Drawing Sheets

(56) References Cited

FOREIGN PATENT DOCUMENTS

| | | | |
|---|---|---|---|
| CN | 105699779 | A | 6/2016 |
| CN | 205488456 | U | 8/2016 |
| CN | 106329042 | A | 1/2017 |
| CN | 107134613 | A | 9/2017 |
| CN | 107146932 | A | 9/2017 |
| CN | 107302122 | A | 10/2017 |
| CN | 108141038 | A | 6/2018 |
| CN | 108493533 | A | 9/2018 |
| JP | S58129802 | A | 8/1983 |
| WO | 2011111894 | A1 | 9/2011 |
| WO | 2018171181 | A1 | 9/2018 |
| WO | 2018171182 | A1 | 9/2018 |

OTHER PUBLICATIONS

European Search Report for application EP 19180702.3, dated Nov. 19, 2019, 8 pages.

* cited by examiner

MICROSTRIP DC BLOCK

FOREIGN PRIORITY

This application claims priority to European Patent Application No. 19180702.3, filed Jun. 17, 2019, and all the benefits accruing therefrom under 35 U.S.C. § 119, the contents of which in its entirety are herein incorporated by reference.

BACKGROUND

The present disclosure relates to microstrip DC blocks, particularly for use in microwave circuits.

High frequency radio transmission and microwave transmission, particularly in the 1 to 10 GHz range, is of great importance to high-speed data transmissions having low power consumption. Additionally, the increasing density of components on printed circuit boards (PCBs) calls for advances that reduce the size of individual components on the PCB to facilitate further component density increases.

The construction of radio frequency (RF) circuits requires consideration of the specific frequencies transmitted in such circuits. Active circuits, such as amplifiers, mixers, and frequency doublers, employ various filters to remove undesirable frequencies. These undesirable frequencies may also include harmonic frequencies of the particular frequencies that are desired in the circuit.

To separate RF circuits from sources of DC current, a DC block can be employed. The DC block creates a physical break in the circuit, preventing the transmission of DC power while allowing the higher RF signals through. This is done because the effect of interference from DC signals can be severely detrimental to the functionality of the RF circuit.

Previous DC blocks employed capacitors to create this separation. However, in some high frequencies, capacitors can have undesirable parasitic effects, such as self-resonance. Moreover, capacitors allow harmonic frequencies to pass without significant losses which then cause interference with the transmitted RF signals. While other components may be used to mitigate these effects, the costs of the DC block increases.

The use of microstrip lines have been proposed and utilised as DC blocks. Such solutions typically use quarter-wave microstrip lines to transmit the desired frequency. Doing so creates two problems: one, quarter-wave microstrip lines in circuits in the 1 to 10 GHz range would have lengths on the order of 5 mm to 50 mm; and two, additional structures are required to filter out harmonic frequencies. In view of these problems, a microstrip DC block that is short in length and that is able to filter out harmonics is desired.

SUMMARY

Viewed from a first aspect, the invention provides a microstrip DC block comprising: a first signal line having a first signal line end; a second signal line having a second signal line end; a first spur-line extending from the first signal line end towards the second signal line end; a first stepped impedance line extending from the first signal line end towards the second signal line end, wherein the first stepped impedance line is parallel to the first spur-line; a second spur-line extending from the second signal line end towards the first signal line end; a second stepped impedance line extending from the second signal line end towards the first signal line end, wherein the second stepped impedance line is parallel to the second spur-line, and wherein the second stepped impedance line is coupled to the first stepped impedance line.

A microstrip is a type of transmission line that may be used for the transmission of microwave, terahertz, or high frequency radio waves. Microstrip structures may be fabricated on printed circuit board (PCB) or as part of monolithic microwave integrated circuits (MMICs) using conventional methods known to the skilled person. Such methods include, but are not limited to, milling, screen printing, and chemical etching. Thus, the microstrip DC block may be a DC block on a PCB formed by one of those techniques. The microstrip structure typically comprises a conducting layer separated from a ground plane by a dielectric substrate, the substrate being any commonly used material, such as FR4, alumina, Rogers, and other RF and microwave substrates.

Microstrip structures may be formed on the conducting layer of a PCB, which is the layer of conducting material on top of the PCB substrate. The conducting layer may be relatively thin compared to the thickness of the substrate. The shape of a microstrip structure may be two-dimensional in the plane of the conducting layer and the structure may be formed by etching or milling the conducting layer of a PCB to remove unwanted conducting material.

The ground layer is on the opposite side of the substrate to the conducting layer. The ground layer may be uniform in thickness and may be formed from the same material as the conducting layer. The ground layer may be defectless or may have defects formed in its surface. A defected ground structure may be used in conjunction with embodiments of the present DC block to provide additional filtering of signal transmissions. Defected ground structures are known in the art and the skilled person may utilise such structures in combination with the present invention without use of inventive skill.

A DC block is a structure that allows transmission of oscillating signals, such as radio frequency (RF) and microwaves, while preventing the transmission of direct current (DC) frequencies. Typical DC block structures used in microstrip transmission lines feature a physical break between signal lines and a coupled structure to allow transmission of RF signals. The oscillating current in one signal line may induce an oscillating current in the other coupled signal line to allow transmission of the signal.

The signal lines of the present invention are for transmitting signals between one another. A signal may be transmitted from the first signal line to the second signal line or from the second signal line to the first signal line. The first and second signal lines may comprise a uniform thickness of conducting material. The first and second signal lines may each have a centreline, wherein the centreline is in the plane of the conducting material. The first and second signal lines may be structurally symmetric about their respective centrelines. The first and second signal lines may have a uniform width in the plane of the conducting material. The sides of a signal line may be parallel to one another and parallel to the centreline of the signal line. The first and second signal lines may not be in physical contact with one another in the conducting plane.

The first signal line and the second signal lines may have ends that are substantially perpendicular to their respective centrelines and to their sides. The first and second signal lines may be positioned such that their centrelines are substantially coincident. The first signal line end may be opposite the second signal line end. The spur-line and the stepped impedance line of the present DC block may be formed between the first and second signal line ends.

A spur-line is a microwave distributed element filter with band-stop characteristics, meaning that a spur-line can act to prevent transmission of particular bands of frequencies. Spur-line structures may comprise a microstrip signal line that breaks up into two or more small microstrip lines. These smaller lines may be coupled to one another and their length and the distance separating each line may be adjusted to achieve the desired filtering effects.

Some microstrip filters may use stepped impedance as part of their structure. This can mean that one part of a microstrip line is a different width to another part of the microstrip. Changing the width of the microstrip line can change the impedance experienced by signals propagating through the line.

The spur-line and stepped impedance line structures extending from each of the signal line ends are not in physical contact with one another in the plane of the conducting material. That is, the conducting material of the first spur-line, the first stepped impedance line, and the first signal line end are not in direct contact with the conducting material of the second spur line, the second stepped impedance line, and the second signal line. This lack of direct contact of the conducting material between the first signal line and the second signal line prevents the transmission of DC signals through the DC block.

A signal propagating through coupled transmission lines may have multiple modes of propagation. The two main modes of propagation are termed "odd" and "even", and the definitions of these modes are well known in the art. Each of the odd and even modes of propagation has an impedance value at which the coupling of the modes is particularly strong. Changing the impedance of a signal line or microstrip structure can change the relative coupling strengths of each mode of propagation.

An advantage of using coupled stepped impedance lines in the present DC block is that they may be shorter than quarter-wave microstrip lines used in conventional microstrip DC blocks. This in turn provides a DC block that is shorter overall than a conventional DC block and decreases the footprint of a DC block component on a PCB, freeing up real estate for other components on the PCB.

The length of the spur-lines and the stepped impedance lines is dependent on the signals being used in the circuit that the DC block is used in. Higher frequencies have shorter wavelengths and so require shorter components than in lower frequency circuits. The first spur-line of the present invention may be shorter in length than the first stepped impedance line. The second spur-line may be shorter in length than the second stepped impedance line. The first and second spur-lines may be substantially parallel with one another. The first and second stepped impedance lines may be substantially parallel with one another. The first and second stepped impedance lines may be adjacent to one another. The first spur-line may be adjacent to the first stepped impedance line. The second spur-line may be adjacent to the second stepped impedance line. The first and second spur-lines and the first and second stepped impedance lines may be substantially parallel to one another. The first and second stepped impedance lines may not be in contact with one another.

The first spur-line and the first stepped impedance line may be substantially parallel to the centreline of the first signal line. The first spur-line may have an edge that is substantially parallel to a side of the first signal line. The first stepped impedance line may extend from a portion of the first signal line end that is closer to the centreline of the first signal line than a portion of the first signal line end from which the first spur-line extends. In other words, the first spur-line may be closer to the side of the first signal line than the first stepped impedance line.

The second spur-line and the second stepped impedance line may be substantially parallel to the centreline of the second signal line. The second spur-line may have an edge that is substantially parallel to a side of the second signal line, and the second spur line extends from a portion of the second signal line end that is diagonally opposite to the portion of the first signal line end from which the first spur-line extends.

The second stepped impedance line may extend from a portion of the second signal line end that is closer to the centreline of the second signal line than the portion of the second signal line end from which the second spur-line extends from. In other words, the second spur-line may be closer to the side of the second signal line than the second stepped impedance line.

The signal to be transmitted may have a frequency denoted by f, a wavelength in free space denoted by $\lambda$, and a wavelength in a microstrip line denoted by $\lambda_g$. The length of the spur-lines may be approximately equal to $\lambda_g/12$. The length of the spur-lines may be such that certain harmonic frequencies are attenuated. The spur-lines may attenuate the odd harmonics of the signal frequency. The first spur-line may be approximately the same length as the second spur-line.

An advantage of the spur-lines having a length of $\lambda_g/12$ is that harmonics that are transmitted in conventional DC blocks may be attenuated. This has the effect of reducing interference with the signal frequency and so the circuit may operate with reduced interference.

The stepped impedance lines may have a narrow portion and a wide portion. The wide portion may be further from the signal line than the narrow portion, and the narrow portion may join the signal line to the wide portion. The wide portion may be wider than the narrow portion in the plane of the conducting layer of a PCB. The first stepped impedance line may be approximately the same length as the second stepped impedance line. The narrow portion of the first stepped impedance line may be the same length of the narrow portion of the second stepped impedance line. The wide portion of the first stepped impedance line may be the same length as the wide portion of the second stepped impedance line. The wide portion of the first stepped impedance line may have the same width as the wide portion of the second stepped impedance line.

The narrow portion and the wide portion of the first stepped impedance line may have a common edge. That is, the stepped impedance line may be widened by increasing its width in a direction substantially perpendicular to the centreline of the first signal line. The common edge of the stepped impedance line may be proximate to the centreline of the first signal line. In other words, in the transition between the narrow portion and the wide portion of the first stepped impedance line, the wide portion extends in a direction away from the centreline of the first signal line.

The narrow portion of the first stepped impedance line may have a length greater than that of the first spur-line. The narrow portion of the second stepped impedance line may have a length greater than that of the second spur-line.

Characteristic impedance (denoted $Z_0$ in the nomenclature) is the ratio of the amplitudes of voltage and current of the signal wave propagating along a transmission line. The input impedance of the coupled stepped impedance line may be equal to the characteristic impedance of the signal line.

For the stepped impedance line, the characteristic impedance of a narrow portion ($Z_1$) is higher than the characteristic impedance of a wider portion ($Z_2$), i.e. $Z_1>Z_2$ The coupled stepped impedance lines may be described with the following parameters: the even- and odd-mode characteristic impedances of coupled lines: $Z_e^1$, $Z_o^1$ for the narrow portion; and $Z_e^2$, $Z_o^2$ for the wider portion; and the electrical lengths $Q_1$ and $Q_2$ for the narrow portion and the wider portion, respectively.

The characteristic impedances of a single transmission line $Z_1$ and $Z_2$ in the case of coupled stepped impedance line are found as the geometric mean of even- and odd-mode impedances:

$$Z_1=\sqrt{Z_e^1 Z_o^1}$$

$$Z_2=\sqrt{Z_e^2 Z_o^2}$$

A parameter characterizing the stepped impedance line is an impedance ratio, which may be defined as:

$$R_Z=\frac{Z_2}{Z_1}$$

The overall electrical length of the stepped impedance line is:

$$Q=Q_1+Q_2=Q_1+\arctan\left(\frac{R_Z}{\tan Q_1}\right)$$

where:

$Q_1$—electrical length of the narrow portion, $Q_1=\beta L_1$, rad;

$Q_2$—electrical length of the wider portion, $Q_2=\beta L_2$, rad;

$\beta$—phase constant, rad/mm;

$L_1$—physical length of the narrow portion, mm;

$L_2$—physical length of the wider portion, mm;

For the presented device, the impedance ratio for the stepped impedance line may be $R_z=0.35$ and the overall electrical length may be $$Q=\frac{\pi}{2.88}\text{ rad.}$$

A conventional uniform impedance DC block has the electrical length $$Q_{\lambda/4}=\frac{\pi}{2}\text{rad.}$$

Based on these possible values, the ratio of the electrical lengths of the proposed DC block and a conventional DC block is then $$\frac{Q}{Q_{\lambda/4}}=0.69.$$

The overall iength of the DC block may be reduced by up to 30% or more in comparison to the conventional quarter wave microstrip DC block.

The physical length of the whole stepped impedance line structure $L_{SIL}$ is:

$$L_{SIL}=L_1+L_2+G$$

where:

G—is a gap between the main signal line and the end of a stepped impedance line.

The lowest spurious frequency $f_{SIL}^S$ for the stepped impedance line may be found from the next equation, where a spurious frequency is the frequency of a signal that is not deliberately created or transmitted:

$$\frac{f_{SIL}^S}{f_0}=\frac{\pi}{\arctan\left(\sqrt{R_Z}\right)}-1=\frac{\pi}{\arctan\left(\sqrt{0.35}\right)}-1=4.88$$

$$f_{SIL}^S=4.88f_0$$

The lowest spurious frequency $f_{\lambda/4}^S$ for a quarter-wave DC block is $3f_0$.

The added spur-line is a bandstop filter (BSF), which rejects the odd harmonics of fundamental frequency. The spur-line has the electrical length $$Q_{SL}=\frac{\pi}{2}$$

at the third harmonic frequency $3f_0$. The physical length of the spur-line $L_{SL}$ is $$L_{SL}=\frac{\lambda_g^{3nd}}{4}=\frac{\lambda_g}{3}\frac{1}{4}=\frac{\lambda_g}{12}$$

where:

$\lambda_g^{3nd}$—waveguide wavelength for the third harmonic of the fundamental frequency, mm;

$\lambda_g$—waveguide wavelength of the fundamental frequency, mm.

Thus, it is an advantage of the present invention that the combination of the spurious response of the coupled stepped impedance lines and the rejection properties of the spur-lines significantly improve the suppression of harmonic frequencies. Based on electrical parameters of the materials being used and the signal properties, the physical dimensions of the resulting DC block may be found using dedicated software or other means.

The gaps between adjacent features, such as the stepped impedance lines and the spur lines, should be feasible with available fabrication technology. All dimensions must meet requirements to Manufacturing Tolerances on a PCB in accordance with the PCB Design Classification.

DRAWING DESCRIPTION

Certain embodiments of the invention will now be described by way of example only and with reference to the accompanying drawings in which.

DETAILED DESCRIPTION

In the RF microstrip terminology, impedance is the opposition of a circuit to the flow of electrical energy from a source. In order to efficiently transmit RF signals across RF components, the skilled person can employ impedance matching when designing these components. Impedance matching takes into account the impedance of the signal input line and the impedance of the signal output line and attempts to make the transition between these impedances as smooth as possible. Doing so minimises power losses across components. This is particularly important where the input signal is weak as it is desirable to transmit the signal across an active RF circuit with as little interference as possible.

A signal at a particular frequency entering a RF circuit may also have harmonic frequencies of the particular frequency. Harmonics can interfere with the signal and with the RF circuit in a detrimental manner Filters may be employed in RF circuits to remove some or all of the harmonics as well as transmission of other unwanted frequencies. A DC block for a RF circuit may be combined with filters to prevent harmonics of a particular frequency or frequencies from entering or propagating through the RF circuit.

Figure 1:
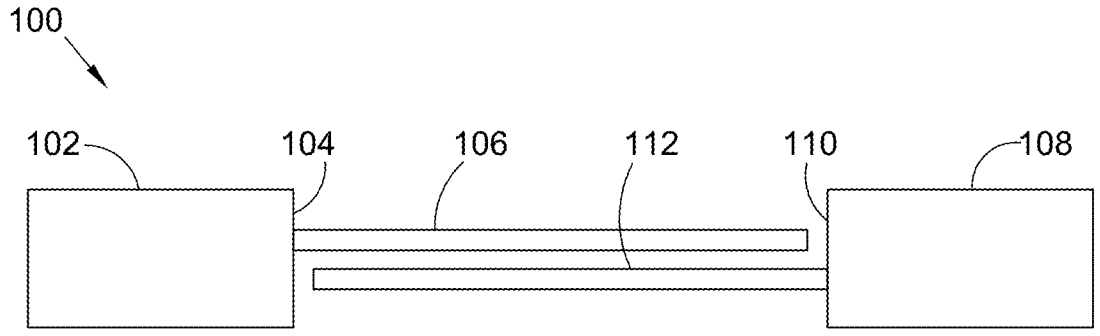
FIG. 1 shows an example of a DC block comprising quarter-wave microstrip lines.

FIG. 1 shows a quarter-wave open-circuit coupled microstrip line 100. Existing RF circuits may use quarter-wave coupled lines as a DC block. The DC block is shown in a schematic view. The quarter-wave coupled line 100 depicted here comprises a first signal line 102 having a first signal line end 104, a first microstrip line 106 connected to the first signal line 102, a second signal line 108 having a second signal line end 110, and a second microstrip line 112 connected to the second signal line 108. The first 106 and second 112 microstrip lines are disposed between the first signal line 102 and the second signal line 108. The first microstrip line 106 extends from the first signal line end 104 towards the second signal line end 110. The first microstrip line 106 does not physically connect to the second signal line 108 in a conducting plane, where the conducting plane is a plane that comprises the coupled line elements. The second microstrip line 112 extends from the second signal line end 110 towards the first signal line end 104 and parallel to the first microstrip line 106. The second microstrip line 112 does not physically connect to the first signal line 102 in the conducting plane. The second microstrip line 112 also does not physically connect to the first microstrip line 106 in the conducting plane.

The first signal line 102 and the second signal line 108 are transmission lines for transmitting signals between each other. A signal transmitted from the first signal line 102 having an alternating current, a frequency f, and a wavelength in the microstrip line of $\lambda_g$ is transmitted to the second signal line 108 by electromagnetic induction. The first 106 and second 112 microstrip lines each have a length of $\lambda_g/4$ and are considered to be coupled to one another.

Figure 2:
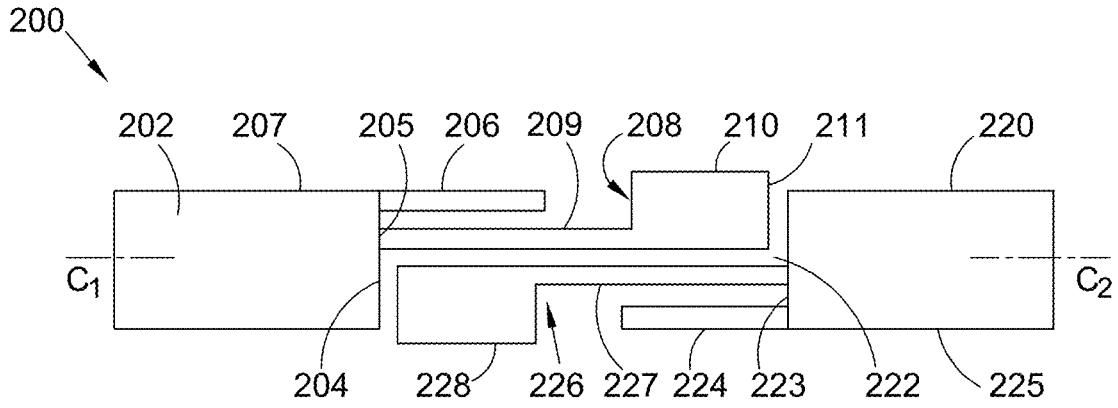
FIG. 2 shows a DC block using coupled stepped impedance lines with spur lines.

FIG. 2 illustrates a DC block 200 using coupled stepped impedance lines with spur lines. The DC block 200 of FIG. 2 comprises a first signal line 202, a first spur-line 206 connected to the first signal line 202, a first stepped impedance line 208 connected to the first signal line 202, a second signal line 220, a second spur-line 224 connected to the second signal line 220, and a second stepped impedance line 226 connected to the second signal line 220. The first signal line 202 has a first signal line end 204 and the second signal line 220 has a second signal line end 222. The first 206 and second 224 spur-lines and the first 208 and second 226 stepped impedance lines are disposed between the first signal line end 204 and the second signal line end 222.

The first 202 and second 220 signal lines have centrelines $C_1$, $C_2$ that are substantially coincident. The first 202 and second 220 signal lines are substantially the same widths as one another. The first signal line end 204 is substantially perpendicular to the centreline $C_1$ of the first signal line. The second signal line end 222 is substantially perpendicular to the centreline $C_2$ of the second signal line 220.

As in the DC block 100 of FIG. 1, the first signal line 202 and the second signal line 220 of FIG. 2 are transmission lines for transmitting signals between each other. A signal transmitted from the first signal line 202 having an alternating current, a frequency f, and a wavelength in the microstrip line $\lambda_g$ is transmitted to the second signal line 220 by electromagnetic induction.

The first spur-line 206 extends from the first signal line end 204 towards the second signal line end 222. The first spur-line 206 is proximate to an outer edge 207 of the first signal line 202. The first stepped impedance line 208 extends from the first signal line end 204 and parallel to the first spur-line 206 towards the second signal line end 222. The first stepped impedance line 208 extends from a portion 205 of the first signal line 202 that is closer to the centreline $C_1$ of the first signal line 202 than the first spur-line 206.

The first stepped impedance line 208 has a narrow portion 209 and a wide portion 210. The narrow portion 209 is connected to the first signal line end 204. The wide portion 210 is connected to the narrow portion 209 and has an end 211 proximate to the second signal line end 222. The narrow portion 209 extends from the first signal line end 204 and has a length greater than the first spur-line 206.

The second spur-line 224 extends from the second signal line end 222 towards the first signal line end 204. The second spur-line 224 is proximate to an outer edge 225 of the second signal line 220, wherein the outer edge 225 of the second signal line 220 to which the second spur-line 224 is proximate is opposite to the outer edge 207 of the first signal line 202 to which the first spur-line 206 is proximate. In other words, the first spur-line 206 and the second spur-line 224 are diagonally opposite to one another.

The second stepped impedance line 226 extends from the second signal line end 222 and parallel to the second spur-line 224 towards the first signal line end 204. The second stepped impedance line 226 also extends parallel to the first stepped impedance line 208. The second stepped impedance line 226 extends from a portion 223 of the second signal line 220 that is closer to the centreline $C_2$ of the second signal line 220 than the second spur-line 224.

Similarly to the first stepped impedance line 202, the second stepped impedance line 220 has a narrow portion 227 and a wide portion 228. The narrow portion 227 is connected to the second signal line end 222. The wide portion 228 is connected to the narrow portion 227 and has an end 229 proximate to the first signal line end 204. The narrow portion 227 extends from the second signal line end 222 and has a length greater than the second spur-line 224.

The wide portion 210 of the first stepped impedance line 208 is proximate to the narrow portion 227 of the second stepped impedance line 226. The wide portion 228 of the second stepped impedance line 226 is proximate to the narrow portion 209 of the first stepped impedance line 208.

The first stepped impedance line 208 and the second stepped impedance line 226 are considered to be coupled to one another. A signal transmitted from the first signal line 202 having an alternating current, a frequency f, and a wavelength in the microstrip line $\lambda_g$ is transmitted to the second signal line 220 by electromagnetic induction. The length of the first 206 and second 224 spur-lines is approximately $\lambda_g/12$. The length of the first stepped impedance line 208 and the second stepped impedance line 226 is shorter than $\lambda_g/4$.

Figure 3:
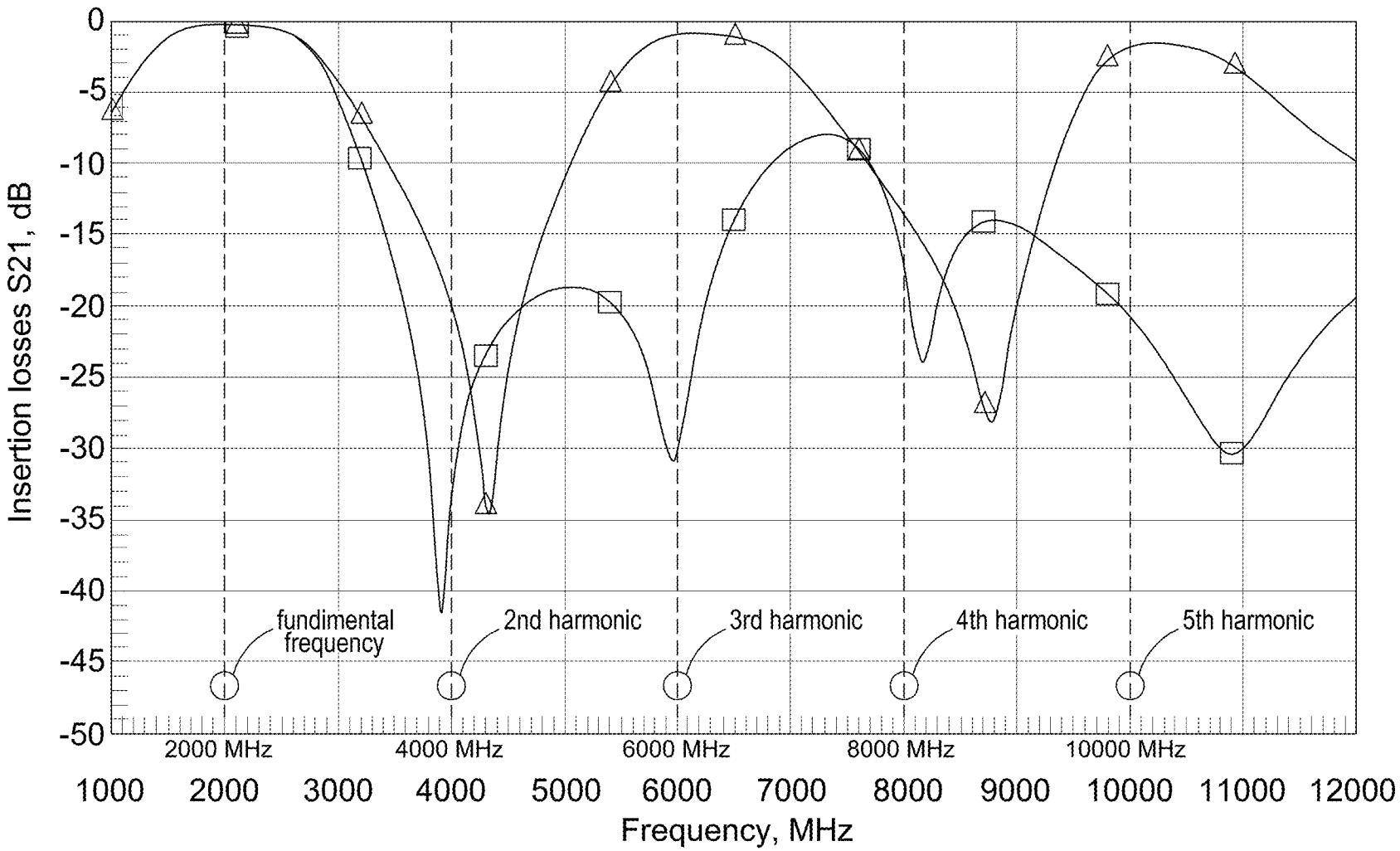
FIG. 3 shows a graph comparing the example DC block of FIG. 1 and the DC block of FIG. 2.

FIG. 3 is a graph comparing the performances of the quarter-wave DC block 100 of FIG. 1 and the DC block 200 of FIG. 2. The line marked by triangles is for that of the quarter-wave DC block 100. The line marked by squares is for that of the exemplary DC block 200. The x-axis tracks the signal frequency and the y-axis tracks insertion losses across each DC block. In this example, the fundamental frequency is approximately 2 GHz. This frequency has harmonics at multiples of 2 GHz.

As can be seen from the graph, the quarter-wave DC block 100 is able to transmit the fundamental frequency and can block the second and fourth harmonics. However, while the third and fifth harmonics are attenuated slightly, the quarter-wave DC block 100 does not attenuate them enough. Therefore, these harmonics would still interfere with the main signal frequency.

On the other hand, the exemplary DC block 200 of FIG. 2, using coupled stepped impedance lines and spur lines, is able to significantly attenuate all of the harmonic frequencies while still transmitting the main signal frequency. Therefore, the exemplary DC block 200 is able to effectively attenuate signal harmonics without compromising on the quality of the main signal.

What is claimed is:

1. A microstrip DC block comprising:

a first signal line having a first signal line end and a first centreline;

a second signal line having a second signal line end and a second centreline;

a first spur-line electrically connected to and extending from the first signal line end towards the second signal line end;

a first stepped impedance line electrically connected to and extending from the first signal line end towards the second signal line end, wherein the first stepped impedance line is parallel to the first spur line;

a second spur-line electrically connected to and extending from the second signal line end towards the first signal line end;

a second stepped impedance line electrically connected to and extending from the second signal line end towards the first signal line end, wherein the second stepped impedance line is parallel to the second spur line, and wherein the second stepped impedance line is coupled to the first stepped impedance line;

wherein the first spur-line extends from a portion of the first signal line end that is proximate to a side of the first signal line, and wherein the first stepped impedance line extends from a portion of the first signal line end that is adjacent to the first spur-line and is proximate to the first centreline;

wherein the second spur-line extends from a portion of the second signal line end that is proximate to a side of the second signal line, and wherein the second stepped impedance line extends from a portion of the second signal line end that is adjacent to the second spur-line and is proximate to the second centreline, and wherein the first and second spur-lines and the first and second stepped impedance lines are parallel to one another.

2. The microstrip DC block of claim 1, wherein the first stepped impedance line has a narrow portion and a wide portion, and wherein the second stepped impedance line has a narrow portion and a wide portion.

3. The microstrip DC block of claim 2, wherein the narrow portion of the first stepped impedance line has a length greater than that of the first spur-line, and wherein the narrow portion of the second stepped impedance line has a length greater than that of the second spur-line.

4. The microstrip DC block of claim 2, wherein the wide portion of the first stepped impedance line is shorter than the narrow portion of the first stepped impedance line, and wherein the wide portion of the second stepped impedance line is shorter than the narrow portion of the second stepped impedance line.

5. The microstrip DC block of claim 2, wherein the wide portion of the first stepped impedance line has an end that is proximate to the second signal line end, and wherein the wide portion of the second stepped impedance line has an end that is proximate to the first signal line end.

6. The microstrip DC block of claim 2, wherein the narrow portion and the wide portion of the first stepped impedance line have a common edge with the stepped impedance line being widened by increasing its width from the common edge in a direction substantially perpendicular to the centreline of the first signal line.

7. The microstrip DC block of claim 1, wherein the DC block is for use with a signal having an alternating current, a frequency f, and a wavelength in the microstrip line $\lambda$ g.

8. The microstrip DC block of claim 7, wherein the first spur-line has a length of approximately $\lambda$ g/12.

9. The microstrip DC block of claim 7, wherein the second spur-line has a length of approximately $\lambda$ g/12.

10. The microstrip DC block of claim 1, wherein the portion of the second signal line from which the second spur-line extends is diagonally opposite to the portion of the first signal line from which the first spur-line extends.

11. The microstrip DC block of claim 1, wherein the first centreline and the second centreline are substantially coincident.

12. The microstrip DC block of claim 1, wherein the overall electrical length, Q, of the stepped impedance line is $$\frac{\pi}{2.88}\text{rad.}$$

* * * * *